United States Patent [19]

Boyes

[11] Patent Number: 4,530,384

[45] Date of Patent: Jul. 23, 1985

[54] DEVICE FOR USE IN A BOTTLE FILLING HEAD

[75] Inventor: Adrian P. Boyes, Edgbaston, England

[73] Assignee: Vickers plc, Birmingham, England

[21] Appl. No.: 543,587

[22] Filed: Oct. 19, 1983

[30] Foreign Application Priority Data

Oct. 19, 1982 [GB] United Kingdom ..... 8229889

[51] Int. Cl.[3] ..... B67C 5/37; B65B 3/04

[52] U.S. Cl. ..... 141/95; 141/129; 141/198; 141/285; 141/392; 138/103

[58] Field of Search ..... 141/37-66, 141/94-96, 192-229, 285-310, 1, 4-8, 129-191; 138/103-110, 32-35

[56] References Cited

U.S. PATENT DOCUMENTS

| | | | |
|---|---|---|---|
| 4,360,045 | 11/1982 | Ahlers | 141/198 |
| 4,369,820 | 1/1983 | Ahlers et al. | 141/198 |
| 4,381,808 | 5/1983 | Ahlers | 141/198 |
| 4,386,635 | 6/1983 | Ahlers et al. | 141/198 |

*Primary Examiner*—Houston S. Bell, Jr.
*Attorney, Agent, or Firm*—Armstrong, Nikaido, Marmelstein & Kubovcik

[57] ABSTRACT

A device for use in a bottle filling head comprises a vent tube in the form of an electrically insulating tubular member and at least two elongate electrical conductors which are substantially parallel, wherein (a) the electrical conductors are embedded in the walls of the tubular member, terminating in connectors at or close to one end of the tubular member and extending out of the opposite lower end of the tubular member; (b) at least the opposite end of the tubular member is open; and (c) the tubular member includes at least one port which permits free communication with the opposite end of the tubular member. The elongate electrical conductors are preferably arranged to act as a level detector.

The invention also provides a bottle filling apparatus incorporating such a device in a bottle filling head. The apparatus also includes a circuit connected to the elongate electrical conductors of the device and arranged to allow the conductors to function as a level detector, the circuit being arranged to produce an output command when the response of said conductors corresponds to a pre-set level within a bottle; and a process control device, responsive to commands from the circuit, for controlling operation of the bottle filling head and supply of liquid thereto.

11 Claims, 4 Drawing Figures

DEVICE FOR USE IN A BOTTLE FILLING HEAD

This invention relates to a device for use in a bottle filling head and to a bottle filling apparatus incorporating such a device.

In prior art bottle filling systems, there are two main arrangements adopted for allowing ingress of liquid and simultaneous egress of gas from the space within a bottle. Both generally use a liquid supply tank in which the liquid feed is achieved by a gas pressure in the region above the liquid in the tank acting with the hydrostatic head of the liquid itself. In the first arrangement, liquid is passed down into the bottle through the interior of a long tube while gas escapes upwardly around the annular space between the walls of the bottle and the long tube. In the second type, a short vent tube is employed and liquid enters the bottle around the outside of the vent tube while gas passes upwardly into the tube and thence away from the bottle. This second type of filling arrangement, known as "short tube filling", has found favour in the past because it has advantages over the other main system. The vent tube acts as an automatic valve to shut off flow of liquid into the bottle when the liquid level reaches the orifice at the base of the vent tube. This happens because when the liquid level reaches the bottom of the vent tube, it seals off the air escape path via the vent tube interior, so that pressure within the bottle increases rapidly as further liquid enters around the exterior of the vent tube. In a short time, a pressure balance is achieved between the interior of the bottle above the level of liquid (i.e. the bottle head space) and the liquid supply tank, and thus no further flow of liquid occurs.

Conventional short tube filler arrangements generally employ a conical spreader located on the vent tube in a position corresponding to the neck region of a bottle which is to be filled. Also, in order to make it possible to use a single vent tube to fill a variety of different bottles to different levels, it has been customary to employ a short vent tube having an elongate side port over which there is disposed a movable sleeve. By moving the sleeve up or down, the level at which the rising liquid within the bottle acts to seal the air escape path can be adjusted. This mechanism is somewhat cumbersome, and usually requires manual adjustment with consequent loss of operating time in automatic bottle filling systems.

While it is an important advantage that a short tube filling system allows automatic control of liquid flow into the bottle, nevertheless it has a number of disadvantages. Firstly, there is a time lag between the moment at which the liquid seals off the air escape path via the vent tube interior and the moment when the pressure balance described above is achieved so that flow of liquid ceases. During this time, liquid continues to enter the bottle resulting in the liquid rising to a level above the base of the vent tube. In addition to this effect, a volume of liquid can be supported by capillary forces in the region between the spreader and the liquid shut-off valve; this volume of liquid, known in the industry as the "gob", may or may not fall into the bottle, and this leads to unacceptable level variations. The combination of these effects is known in the industry as "secondary fill". It is desirable to minimise secondary fill in order to make it possible to control the level of liquid dispensed as accurately as possible while being consistent with the requirement to achieve a pre-set minimum volume input. It will also be appreciated that a filling system of the type just described does not meter the input of liquid; the quantity of liquid dispensed into a bottle is principally determined by the volume of the bottle itself. There can be considerable variation in volume between different samples of similar bottles, and consequently there is a significant variation in the volume and level of liquid dispensed. This is most undesirable.

In conventional systems as described above, a mechanical valve closes off the liquid supply channel to the bottle a predetermined time after liquid fill has commenced. In order to ensure that the liquid supply continues until the pressure equalisation mechanism described above has taken effect to prevent further ingress of liquid, it is necessary to make the predetermined delay longer than would be required if (a) all filling valves in a bottle filling apparatus were to operate at identical filling rates, and (b) all bottles of a given nominal size were identical in volume. Similarly, it is unsatisfactory for the liquid flow to be stopped by a mechanical valve before the liquid has risen to a level sufficient to seal off the air escape path via the vent tube interior, since this could result in visibly different filling levels in a series of similar bottles. This also requires the conventional timing system to have a relatively wide safety factor which tends to slow down the operating cycle and to permit an excess of liquid to enter the bottle due to factors such as pressure fluctuations and mechanical shock during the period after the liquid supply valve has completed its fill but before it has been physically closed.

When the liquid fill is completed, it is necessary to reduce the gas pressure above the liquid to atmospheric pressure in order to permit removal of the bottle from the filling head. This process is termed snifting. After mechanically closing off the liquid flow channel and the gas escape path from the vent tube interior, the upper region of the bottle is brought to atmospheric pressure via a snift valve. As a result, the gas pressure in the vent tube is reduced and consequently the gas expands and ejects liquid from the bottom of the vent tube. This can occur with some violence, leading to agitation of the bottle contents and possibly to frothing. It is undesirable for such agitation to occur, and frothing can be a serious problem. These difficulties can be reduced by sealing off the base of the vent tube, and using only one or more lateral ports for entry of gas into the vent tube. With such a system, liquid ejection on snift is lateral and results in less disturbance of the bottle contents. Another way of assisting is to reduce the gas volume in the vent tube by positioning the shut-off valve nearer the top of the sleeve which surrounds the vent tube itself. This, however, has the disadvantage that the liquid level may occasionally rise sufficiently for it to reach the shut-off valve; liquid would then be trapped in the vent tube, and would have to be purged before another bottle filling operation could take place.

A disadvantage inherent in using a system in which the liquid acts to seal off the air escape path is that in some circumstances gas can escape through the meniscus, thus allowing further liquid to enter the bottle with the result that sometimes the bottle is completely filled. This is most undesirable and can lead to serious problems in subsequent stages of the bottling operation.

Since in the conventional system as described above the vent tube is connected to the head space of the pressurised liquid supply tank, a separate outlet for snifting is generally required.

A further disadvantage of the prior art short tube filler is that, at the completion of fill, the vent tube is partially immersed in the liquid. The removal of the bottle from the bottle filling head, and therefore the withdrawal of the vent tube from the liquid, results in an undesirable change in the liquid level.

The present invention aims to avoid or at least ameliorate the above problems encountered conventionally with short fill tube arrangements.

According to one aspect of the present invention, there is provided a device for use in a bottle filling head for filling bottles with liquids, which device comprises a vent tube in the form of an electrically insulating tubular member and at least two elongate electrical conductors which are substantially parallel, wherein (a) the electrical conductors are embedded in the walls of the tubular member, terminating in connectors at or close to one end of the tubular member and extending out of the opposite lower end of the tubular member; (b) at least said opposite end of the tubular member is open; and (c) the tubular member includes at least one port which permits free communication with the said opposite end of the tubular member.

The device of the present invention will generally be used with circuitry which permits the elongate electrical conductors to act as sensitive level detectors. Preferably, the at least two elongate electrical conductors are in the form of stiff wires or are constituted by a probe as described and claimed in our co-pending European patent application No. 83306342.3. This describes a probe for detecting the level of a liquid or of a flowable, pulverulent solid in a container, which comprises first, second and third elongate, electrically conductive elements all of which are free from direct electrical contact with each other and are dispsed substantially in a mutually parallel relationship, the second and third elements being substantially equal in length and being coated with an electrically insulating, liquid-impermeable coating over substantially the whole of their length except for (I) a first region intermediate the ends of the second element and (II) a second region intermediate the ends of the third element, the mid-points of said first and second regions being spaced from one another in the axial direction; means for applying an electrical potential to said first electrically conductive element; and means for comparing the current flowing through, or the potential difference between, the second and third electrically conductive elements when said electrical potential is applied to the first electrically conductive element. Such a probe compares the electrical characteristics of the second and third electrodes, e.g. by comparing the current flowing through them; associated circuitry can be provided to effect process control, e.g. valve operation, as a function of this comparison. In consequence, the level detection provided by the probe, and any control functions exercised in response thereto, are independent of the nature of the material in the container and of environmental parameters such as temperature.

If the vent tube in the device of the present invention is fitted with just two elongate electrical conductors, the device will generally be used in conjunction with a further electrode arrangement comprising two elongate conductors, this further electrode arrangement being disposed in the supply tank for the liquid which is to fill the containers. The two electrodes in the liquid tank function as a feeder electrode and a reference electrode, while the two conductors in the device of this invention function as a feeder electrode and as a measurement electrode. The two feeder electrodes can be connected to a common power supply.

When the elongate electrical conductors are in the form of stiff wires, it is preferred that the upper regions thereof adjacent to the base of the vent tube be coated with an electrically insulating material in order to prevent any electrical contact between the conductors in the event that any liquid remains in contact with the base of the vent tube.

The lower end of the vent tube is open in the device of the present invention. The upper end may be closed off by a cap through which connectors for the elongate electrical conductors protrude. Alternatively, the upper end of the vent tube can be open so as to constitute the port which permits free communication with the lower end thereof. Where the upper end of the vent tube is capped, it is necessary to provide at least one port in the side of the vent tube in order to provide a gas flow path via the vent tube interior. Where there is a port in the side of the tubular member, the port will generally be closer to the upper, capped end of the tubular member than to the lower, open end.

According to a second aspect of the invention, there is provided a bottle filling apparatus which comprises (1) a conveyor system for conveying empty bottles to a bottle filling station; (2) a bottle filling head, including a device as hereinbefore defined, located at the bottle filling station; (3) means for bringing bottles sequentially into contact with the bottle filling head; (4) means for supplying a liquid via the bottle filling head to the exterior surface of the vent tube of said device; (5) circuit means connected to the elongate electrical conductors of said device and arranged to allow said conductors to function as a level detector, the circuit means being arranged to produce an output command when the response of said conductors corresponds to a predetermined liquid level within a bottle which is being filled; (6) process control means, responsive to commands from said circuit means, for controlling operation of the bottle filling head and supply of liquid thereto; and (7) means for conveying filled bottles away from said filling station.

In one presently preferred embodiment of bottle filling apparatus in accordance with this invention, the bottle filling head includes a device of the invention which itself has two elongate electrical conductors in the form of substantially parallel, stiff wires which are free from electrical insulation except in a short region adjacent to the base of the vent tube. In this embodiment, the means for supplying liquid includes a liquid feed tank having appropriate feed lines and containing an electrode arrangement comprising two elongate conductors which can conveniently be fabricated in the same way as the elongate conductors forming part of the device of the invention. The electrodes in the liquid tank can then function as a current feeder electrode and a reference electrode and can be used in conjunction with the two conductors in the device within the bottle filling head and with the circuit means to provide an output signal corresponding to the level of liquid within a bottle which is being filled. This can be achieved relatively simply if the electrode arrangement within the liquid supply tank is identical in configuration and electrical characteristics to the two elongate electrical conductors in the device within the bottle filling head. With such an arrangement, the reference electrode within the liquid supply tank provides a reference signal while one of the elongate electrical conductors in the said device gives an output which is dependent upon the level within the bottle being filled. If the configuration and/or electrical characteristics of the tank electrode arrangement differ from those of the two conductors in the device in the bottle filling head, the circuit means can be modified to take into account such differences as may exist.

Where an output from the elongate conductors of the device within the bottle filling head is obtained by comparing a level-dependent current with a reference current, the circuit means preferably includes a pair of operational amplifiers each of which is in parallel with a resistor and the inputs to which are connected to the source of reference current and the source of level-dependent current, respectively, the output of one of said operational amplifiers being connected to one input of a comparator via a rectifying arrangement, and the output of the other of said operational amplifiers being connected to the other input of said comparator via a rectifying arrangement and a potentiometer. The potentiometer can be used to reduce the amplified reference current to a pre-set proportion of its original value. As the level-dependent current increases, it is amplified by the other of the operational amplifiers and rectified by its associated rectifying means. The comparator then compares the proportioned reference current with the level-dependent current, and gives an output signal when these two input parameters are equal. This signal can constitute the command function for the process control means and, in particular, can be used to close a valve supplying liquid to the exterior surface of the vent tube of the device.

Where the electrical conductors of the device of this invention constitute a probe as defined above, or function to monitor liquid level in any other suitable way, the device and the bottle filling apparatus of this invention presents a number of advantages. Firstly, the cut-off of liquid flow can be determined by characteristics sensed by the elongate electrical conductors as a function of the liquid level in e.g. the bottle, and not by the physical position of the base of the vent tube. This permits very accurate control of the level of liquid dispensed. Secondly, the liquid fill can be stopped before the liquid reaches the bottom of the vent tube. The vent tube can also be used as the snift outlet as well as the gas pressure inlet/outlet. A further result is that during snifting, gas within the vent tube expands into a gas space, thus minimising disturbance of the liquid in the bottle at a critical time. Thirdly, the volume of liquid displaced by the device is very small, being merely the volume of the electrical conductors which extend out of the vent tube. Fourthly, using the elongate electrical conductors in a system for controlling liquid fill means that a positive shut-off of liquid supply may be obtained immediately, thereby avoiding the gob element of secondary fill and its associated problems. Fifthly, the desired filling level can be set and adjusted as required without stopping the filling process. Sixthly, the vent tube need not be so robust as those conventionally found in the prior art; in some cases, prior art vent tubes may damage bottles if there is any misalignment in the course of a bottle filling operation.

The device of the invention can be fixed to an alignment cone as is conventionally used to centre a bottle on a bottle filling head. The vent tube in a device of this invention can have a fixed or adjustably positioned spreader, or it can operate without one.

The electrical conductors of the device can function at the end of a fill cycle in order to monitor the filled level; this has not generally been possible with prior art systems. Similarly, they can be used during filling to measure flow rate into the bottle. They can also be used in a diagnostic capacity to measure, for example, the Brix value of a drink, which is an important parameter in product quality and process control.

Where the or some of the electrical conductors are in the form of stiff wires, their positioning within the walls of the vent tube can be facilitated by using a tube of circular cross-section with a central, elliptical bore.

A device in accordance with the present invention is easy to remove from a bottle filling head with which it is used. A simple screw-thread attachment may be used, facilitating withdrawal of the vent tube from the top end of the bottle filling head. The vent tube is also easy to make, for example by injection moulding.

For a better understanding of the invention, and to show how the same may be carried into effect, reference will now be made, by way of example, to the accompanying drawing, in which.

Figure 1:
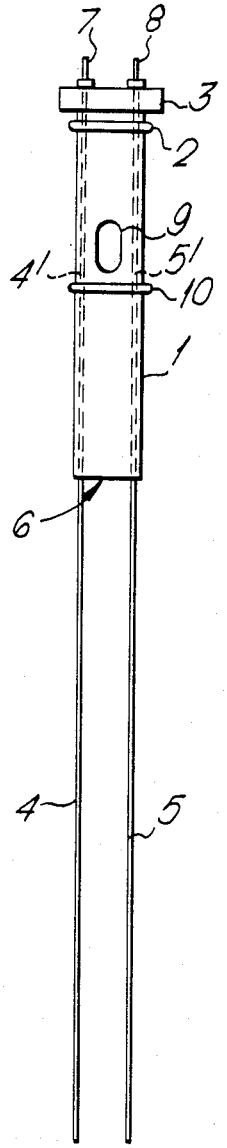
FIG. 1 shows a side elevational view of one embodiment a device in accordance with the invention.
Figure 2:
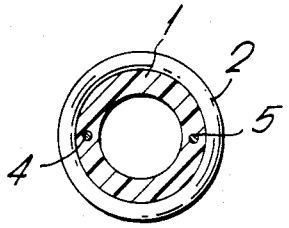
FIG. 2 shows a view from below of the device shown in FIG. 1.
Figure 3:
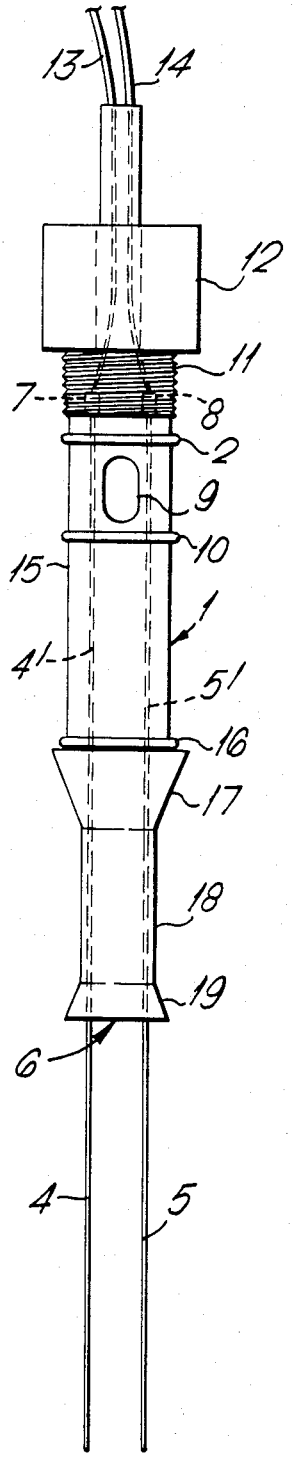
FIG. 3 shows a side elevational view of a second embodiment of the device.

Referring now to the drawings, it will be seen that the embodiments of FIGS. 1 and 3 are generally similar in form. Identical reference numerals are used to denote the same items in these two figures. The device of the invention comprises a vent tube in the form of a rigid tubular member 1 formed of an electrically insulating material, e.g. PTFE or PVC, the upper end of which carries a flexible elastomeric sealing ring 2 and is closed off by a cap 3. A pair of elongate, electrically conductive elements 4 and 5 are embedded in the wall of tubular member 1 (as indicated by the dashed lines 4' and 5') and extend out of the lower end 6 of member 1. The electrically conductive elements 4 and 5 terminate at connectors 7 and 8, respectively, formed on the upper surface of cap 3. The lower end 6 of tubular member 1 is open and communicates, via the interior of the hollow member, with a port 9 which is located in the side of the hollow tubular member 1 just above its mid-point. A second sealing ring 10 is located just below port 9.

The conductive elements 4 and 5 are substantially equal in length and in this embodiment have the same electrical characteristics. They are mutually parallel, and spaced apart by about 8 mm.

In the embodiment of FIG. 3, cap 3 is replaced by a screw-threaded portion 11 and a block 12. Connectors 7 and 8 are located within portion 11 and leads 13 and 14 pass through block 12. The vent tube 1 includes a cylindrical upper portion 15 which includes three seals 2, 10 and 16, the last of which abuts a downwardly flared portion 17 of the vent tube. Portion 17 adjoins a relatively narrow cylindrical section 18 which terminates in an outwardly flared portion 19 which acts, in use, as a spreader. In a further embodiment (not shown), the outer surfaces of portions 18 and 19 can have a surface configuration, e.g. one or more helical grooves or fins to impart a swirl motion to incoming liquid. With swirl motion, the need for a spreader to ensure that incoming liquid is directed onto the bottle wall is reduced, and such a spreader may be eliminated.

In use, the device of this invention will be inserted into a bottle filling head and suitable electrical circuitry will be provided for making connections at 7 and 8 and for taking whatever measurements are to be made with the elements 4 and 5. The seal 2 will contact an internal orifice within the bottle filling head and will provide a liquid-tight seal between the head and the device. Liquid will flow from the bottle filling head around the outside of the lower end of tubular member 1 which will be inserted into the bottle which is undergoing a filling operation. Gases expelled from the bottle and/or liberated in the course of this filling operation will enter the open lower end 6 of tubular member 1 and pass upwardly to port 9, from which they will be vented (e.g. to the head space of the pressurised liquid supply tank) externally of the bottle filling head.

Figure 4:
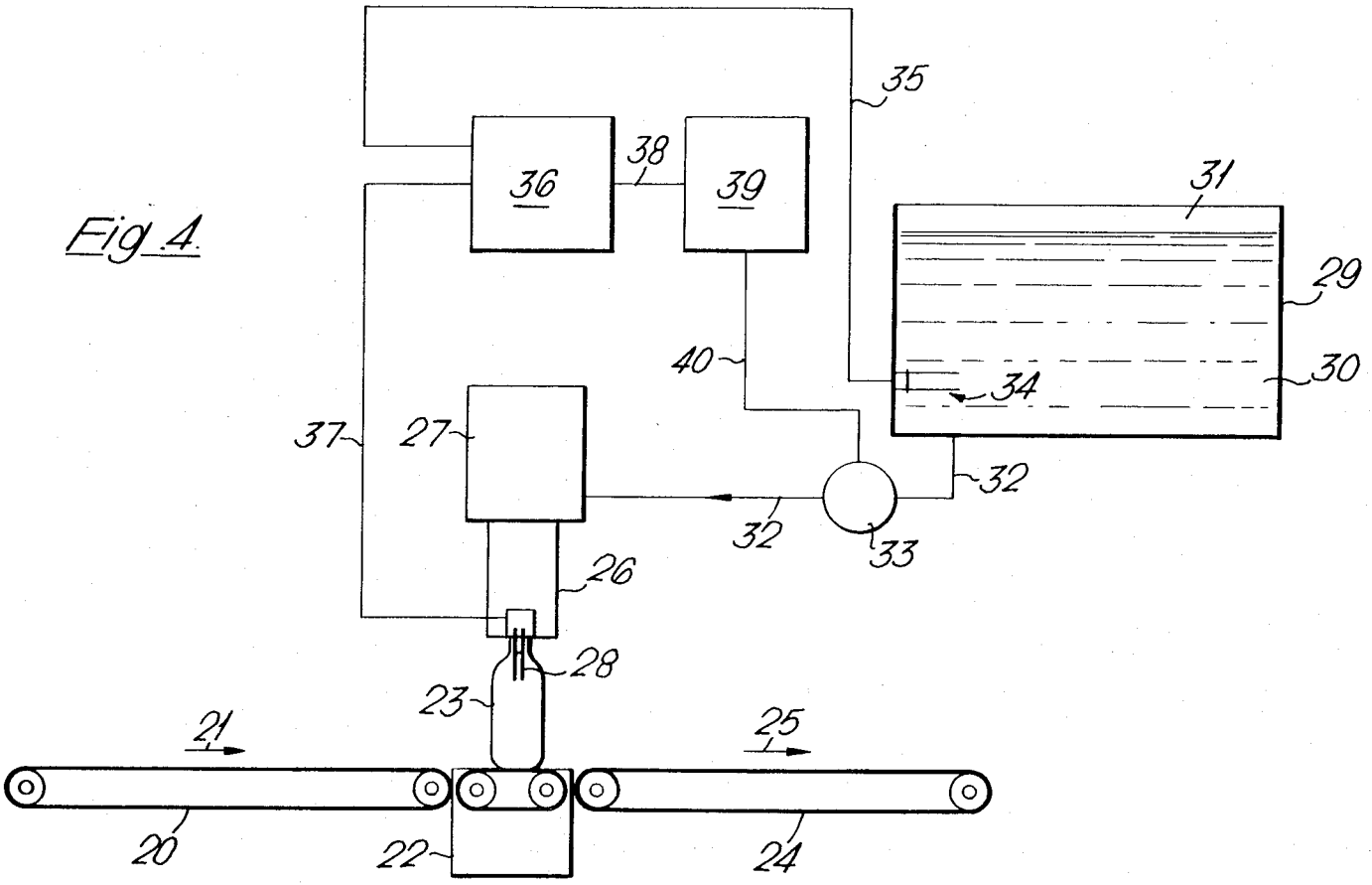
FIG. 4 shows a schematic view of a bottle filling apparatus in accordance with the invention.

The bottle filling apparatus illustrated schematically in FIG. 4 will now be described. The apparatus comprises a conveyor system 20 for conveying empty bottles in the direction of arrow 21 towards a bottle filling station 22. A single empty bottle 23 is shown in the drawing. A further conveyor 24 is provided for moving filled bottles in the direction of arrow 25 away from bottle filling station 22. A bottle filling head 26 is controlled by a mechanism 27 which brings the bottle filling head 26 and a bottle such as 23 into contact in order to effect the desired filling operation. Filling head 26 includes a device of the invention, such as that illustrated in FIG. 3, and the device (denoted by reference 28) is shown extending into the bottle 23. A tank 29 contains liquid 30 with which the bottle is to be filled. Tank 29 has a head space 31 which is filled with gas (e.g. carbon dioxide) under pressure. The outlet from tank 29 is a line 32 which includes a liquid supply valve 33. For ease of illustration, valve 33 is shown remote from the filling head 26; in practice, this valve will usually be within the filling head 26 itself.

An electrode arrangement 34 is positioned within the body of liquid 30 in tank 29. The electrical output from electrode arrangement 34 passes along line 35 to circuit means 36. Similarly, the electrical output from the two elongate conductors of device 28 pass via line 37 to circuit means 36. The circuit means 36 is arranged to produce an output via line 38 when the conductors of device 28 produce an electrical output which corresponds to a pre-set liquid level within bottle 23. Output 38 is supplied to process control means 39 which, inter alia, is connected via line 40 to valve 33.

The electrode arrangement 34 comprises a pair of electrodes which are similar in configuration and in electrical characteristics to the two elongate electrical conductors forming part of the device 28. One of the two electrodes constituting item 34 is a current feeder electrode, and the other acts as a reference electrode to provide a reference current which is fed into the circuit means 36. One of the elongate electrical conductors of device 28 similarly functions as a current feeder electrode, while the other of the two conductors acts as a measurement electrode and its output is dependent upon the level of liquid in bottle 23. This level-dependent output is that which is fed via line 37 to circuit means 36. When the inputs 35 and 37 to circuit means 36 are in a predetermined mutual relationship with one another, the circuit means 36 issues a command signal via line 38 to process control means 39 which shuts off liquid supply valve 33, thereby terminating flow of liquid into bottle 23. For the reasons set out initially, it is desirable to reduce the volume of liquid between valve 33 and the end of line 32 which is within the bottle filling head close to the upper part of the exterior surface of the vent tube of device 28. It is for this reason that valve 33 will usually be within bottle filling head 26 close to device 28.

By employing elements 28, 33, 34, 36 and 39 in the manner described above, it is possible to operate a bottle filling cycle with greater efficiency than has generally been possible hitherto.

I claim:

1. A device for use in a bottle filling head for filling bottles with liquids, which device comprises a vent tube in the form of an electrically insulating tubular member and at least two elongate electrical conductors which are substantially parallel, wherein (a) the electrical conductors are embedded in the walls of the tubular member, terminating in connectors at or close to one end of the tubular member and extending out of the opposite lower end of the tubular member; (b) at least said opposite end of the tubular member is open; and (c) the tubular member includes at least one port which permits free communication with said opposite end of the tubular member.

2. A device as claimed in claim 1, wherein said elongate electrical conductors are in the form of stiff wires.

3. A device as claimed in claim 1, wherein said elongate electrical conductors are in the form of first, second and third elongate, electrically conductive elements all of which are free from direct electrical contact with each other, the second and third elements being substantially equal in length and being coated with an electrically insulating, liquid-impermeable coating over substantially the whole of their length except for (I) a first region intermediate the ends of the second element and (II) a second region intermediate the ends of the third element, the mid-points of said first and second regions being spaced from one another in the axial direction.

4. A device as claimed in claim 2, wherein there are two elongate electrical conductors in the form of stiff wires.

5. A device as claimed in claim 2 or 4, wherein the upper regions of said stiff wires adjacent to the base of the vent tube are coated with an electrically insulating material.

6. A device as claimed in any one of claims 1–4, wherein the upper end of said vent tube is closed off by a cap through which connectors for the elongate electrical conductors protrude, and wherein said at least one port is located in the side of the vent tube close to the upper, capped end thereof.

7. A device as claimed in any one of claims 1 to 4, wherein the upper end of the vent tube is open and constitutes said at least one port.

8. A bottle filling apparatus which comprises (1) a conveyor system for conveying empty bottles to a bottle filling station; (2) a bottle filling head, including a device as claimed in any one of claims 1–4, located at the bottle filling station; (3) means for bringing bottles sequentially into contact with the bottle filling head; (4) means for supplying a liquid via the bottle filling head to the exterior surface of the vent tube of said device; (5) circuit means connected to the elongate electrical conductors of said device and arranged to allow said conductors to function as a level detector, the circuit means being arranged to produce an output command when the response of said conductors corresponds to a predetermined liquid level within a bottle which is being filled; (6) process control means, responsive to commands from said circuit means, for controlling operation of the bottle filling head and supply of liquid thereto; and (7) means for conveying filled bottles away from said filling station.

9. Apparatus as claimed in claim 8, wherein said circuit means is arranged so as to compare a reference current with a current which is dependent upon the level of liquid within a bottle being filled, and includes a pair of operational amplifiers each of which is in parallel with a resistor and the inputs to which are connected to the source of reference current and the source of level-dependent current, respectively, the output of one of said operational amplifiers being connected to one input of a comparator via a rectifying arrangement, and the output of the other of said operational amplifiers being connected to the other input of said comparator via a rectifying arrangement and a potentiometer.

10. Apparatus as claimed in claim 9, wherein the means for supplying a liquid includes a liquid supply tank incorporating an electrode arrangement for generating said reference current.

11. Apparatus as claimed in claim 10, wherein the device in the bottle filling head has two elongate electrical conductors, and wherein said two elongate electrical conductors are substantially identical in configuration and in electrical characteristics with two electrodes constituting said electrode arrangement within the liquid supply tank.

* * * * *